US007192536B2

(12) United States Patent
Service

(10) Patent No.: US 7,192,536 B2
(45) Date of Patent: Mar. 20, 2007

(54) ELECTRICALLY CONDUCTIVE POLYMER FILMS AND PROCESS FOR MAKING SAME

(75) Inventor: Arnold Lewis Montgomery Service, East Amherst, NY (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 91 days.

(21) Appl. No.: 11/152,309

(22) Filed: Jun. 14, 2005

(65) Prior Publication Data

US 2006/0063875 A1 Mar. 23, 2006

Related U.S. Application Data

(62) Division of application No. 10/728,251, filed on Dec. 3, 2003, now Pat. No. 6,932,921.

(60) Provisional application No. 60/438,171, filed on Jan. 6, 2003.

(51) Int. Cl.
*H01B 1/12* (2006.01)
*B28B 13/06* (2006.01)

(52) U.S. Cl. ..... 252/500; 264/344; 156/242

(58) Field of Classification Search ..... 252/500, 252/512; 428/922; 427/224, 58; 156/242, 156/244.24; 264/334
See application file for complete search history.

(56) References Cited

U.S. PATENT DOCUMENTS

| | | | | |
|---|---|---|---|---|
| 2,419,008 | A | 4/1947 | Coffman et al. | |
| 2,599,300 | A | 6/1952 | Upson | |
| 2,953,818 | A | 9/1960 | Bartron | |
| 3,139,470 | A | 6/1964 | Prengle et al. | |
| 3,524,906 | A | 8/1970 | Schmitt et al. | |
| 4,902,444 | A | 2/1990 | Kolouch | |
| 4,931,324 | A | 6/1990 | Ellison et al. | |
| 5,000,875 | A | 3/1991 | Kolouch | |
| 5,707,697 | A | 1/1998 | Spain et al. | |
| 5,968,417 | A | 10/1999 | Viswanathan | |
| 6,059,999 | A | 5/2000 | Viswanathan | |
| 6,242,547 | B1 | 6/2001 | Uschold | |
| 6,299,800 | B1 | 10/2001 | Viswanathan | |
| 6,403,740 | B1 | 6/2002 | Uschold | |
| 6,440,332 | B1 * | 8/2002 | Geer et al. | 252/512 |
| 6,764,617 | B1 | 7/2004 | Viswanathan et al. | |

FOREIGN PATENT DOCUMENTS

| | | | |
|---|---|---|---|
| JP | 6124708 | A | 5/1994 |

OTHER PUBLICATIONS

Rodrigues et al "Polyaniline/lignin blends: thermal analysis and XPS", European Polymer Journal 37(2001), 2217-2223.*

* cited by examiner

*Primary Examiner*—Mark Kopec

(57) ABSTRACT

A self-supporting conductive polymer film having distributed therein an electrically conductive polymer composition containing linearly conjugated π-electron systems and residues of sulfonated lignin or a sulfonated polyflavonoid. The conductive polymer film preferably has a surface resistivity of from about $10^2$ ohms per square to about $10^{10}$ ohms per square and is preferably formed from a liquid dispersion of thermoplastic polymer having the electrically conductive polymer composition distributed therein. In a preferred embodiment, heat sealable conductive fluoropolymer films are prepared.

11 Claims, No Drawings

ELECTRICALLY CONDUCTIVE POLYMER FILMS AND PROCESS FOR MAKING SAME

This application is a DIV of Ser. No. 10/728,251 (filed Dec. 3, 2003, now U.S. Pat. No. 6,932,921)

FIELD OF THE INVENTION

This invention relates to electrically conductive self-supporting polymer films and methods for preparing them.

BACKGROUND OF THE INVENTION

Increasingly, metals and inorganic semiconductors are being replaced in the electronics industry by electrically conductive organic polymers also known as ICP's (inherently conductive polymers). A new electrically conductive polymer system was developed by NASA's Kennedy Space Center and is described in U.S. Pat. Nos. 5,968,417 and 6,059,999 to Viswanathan. The polymer is an electrically conductive composition of linearly conjugated π-electron systems and residues of a sulfonated lignin or sulfonated polyflavonoid. The new system has increased water solubility, increased processibility and is highly crosslinkable. Of particular interest is lignosulfonic acid doped polyaniline. Lignosulfates are byproducts of the paper making industry and are environmentally safe and inexpensive. The lignosulfonic acid improves the solubility of the conjugated π-system, polyaniline.

Viswanathan developed these polymer systems for antistatic coatings to be applied on fibers and fabrics. The antistatic coating is useful for garments worn in clean rooms to prevent sparking and igniting in a combustible atmosphere.

Another use of lignosulfonic acid doped polyaniline is for corrosion control. Under the brand name of Ligno-PANI™, GeoTech Chemical Company (Akon, Ohio) has developed a coating additive of the inherently conductive polymer. Together with metal particles, Ligno-PANI™ is part of a coating system that GeoTech markets under the brand name CATIZE™. The CATIZE™ system is employed to inhibit corrosion on architectural structures such as steel bridges by slowing the growth of rust.

There are a number of potential uses for ICP's in self-supporting films. ICP's would have enormous value if they could be uniformly distributed into a plastic matrix and processed into films or sheeting for possible uses in the field of electrodissipative packaging, in laminate structures that protect work surfaces used in precision manufacture of semiconductor chips, or in wall paper in clean rooms and similar environments.

Of special interest would be the incorporation of ICP's into fluoropolymer films. Fluoropolymers, in spite of their relatively high cost, are widely used in electrical applications. Among their advantages are their resistance to chemical attack, especially oxidation, their high melting points, and their retention of useful properties over a very wide range of temperatures. Carbon filled fluoropolymer compositions for static-electric discharge applications are known and preferred to other conductive polymer systems when chemically active environments are to be encountered due to their relative inertness and solvent resistance. Carbon black is typically for the form of carbon used in these compositions However, there are difficulties in manufacturing self-supporting films of fluoropolymer when carbon black is added to achieve conductivity. One difficulty is the relatively large and rapid rise in effective melt viscosity of the blend that occurs as the carbon black is added to the fluoropolymer. This large and rapid viscosity increase results in more difficult and time consuming processing. In addition, streaking or skipping can occur during film manufacturing and it is difficult to provide batch-to-batch uniformity. At lower levels of carbon black where there is less influence on effective melt viscosity, the electrical conductivity can be lost entirely or may be in a range below that desired.

A self-supporting, conductive polymer film that provides a suitable level of conductivity, that can be manufactured easily with consistent uniformity would be highly desirable.

BRIEF SUMMARY OF THE INVENTION

The invention provides a self-supporting conductive polymer film having distributed therein an electrically conductive polymer composition containing linearly conjugated π-electron systems and residues of sulfonated lignin or a sulfonated polyflavonoid. In a preferred embodiment, the self-supporting films have a minimum tensile strength of at least 21 MPa and an elongation-to-break of at least 6%. In an especially preferred embodiment of the invention, the conductive polymer film has a surface resistivity of less than about $10^{10}$ ohms per square, preferably from about $10^{2}$ ohms per square to about $10^{10}$ ohms per square. The self-supporting conductive polymer film is preferably formed from a liquid dispersion of thermoplastic polymer having the electrically conductive polymer composition distributed therein. More preferably the polymer film is formed from the liquid dispersion at a processing temperature of less than 225° C.

According to a further embodiment of this invention, self-supporting conductive polymer film is produced by preparing a coalescible liquid dispersion of fluoropolymer and an electrically conductive polymer composition containing linearly conjugated π-electron systems and residues of sulfonated lignin or a sulfonated polyflavonoid; casting the liquid dispersion onto a support to form a conductive polymer film on the support; and drying and coalescing the conductive polymer film while in contact with the support. In a preferred embodiment the dried film is removed from the support. Alternatively, the self-supporting films can be made by solvent aided extrusion or by melt extrusion. All processing temperatures for fabricating the self-supporting film are preferably below 225° C.

Heat sealable films can be prepared from the films of this invention.

DETAILED DESCRIPTION OF THE INVENTION

Polymer Films

The invention relates to self-supporting polymer films containing electrically conductive polymers. By self-supporting it is meant, that a polymer film or sheet has self integrity and is formed either without the use of a support or can be removed from a support as a self-supporting film. Films in accordance with the invention preferably have a minimum tensile strength of 21 MPa and an elongation-to-break of at least 6% (in accordance with ASTM D638). Self-supporting films usually have a thickness between about 0.25 mil (6.4 μm) to about 15 mils (381 μm) and are distinguished from coatings which are not self-supporting in the dried state. Although the films in accordance with the invention are self-supporting, they are often used in conjunction with other polymer materials or applied to substrate materials such as metals, wood, glass and plastics in the form of laminate structures.

The invention is applicable to a wide range of thermoplastic and thermoset organic polymers. Examples of thermoplastic polymers include vinyls, polyolefins, acrylics, and fluoropolymers. Examples of thermoset polymers include epoxy resins, polyurethanes, polyethers, crosslinked vinyl and acrylic resins.

Preferred polymers for use in this invention are fabricable into self-supporting films at processing temperatures of less than about 225° C. By fabricable into self-supporting films at processing temperatures of less than about 225° C. it is meant that all processing steps used to produce self-supporting films of polymers of this invention are conducted at temperatures below about 225° C. Such processing steps include, melting, dispersing, casting, extruding, drying, crosslinking and other well known processing steps for forming a self-supporting film. If temperatures above 225° C. are employed in preferred systems containing for example lignosulfonic acid doped polyaniline, the conductive properties of the electrically conductive polymer can be degraded.

Preferred in this invention are a wide range of fluoropolymers such as polymers and copolymers of trifluoroethylene, hexafluoropropylene, monochlorotrifluoroethylene, dichlorodifluoroethylene, tetrafluoroethylene, perfluorobutyl ethylene, perfluoro(alkyl vinyl ether), vinylidene fluoride, vinyl fluoride, among others and including blends thereof and blends of fluoropolymers with nonfluoropolymers. Fluoropolymers which are fabricable at a temperature of less than 225° C. are more preferred for the practice of the invention.

Especially preferred in the present invention are polymers and copolymers of vinyl fluoride (VF), polymers and copolymers of vinylidene fluoride (VF2), and blends of these, polymers and copolymers of vinylidene fluoride with nonfluoropolymers, e.g., acrylic polymers. For example, the fluoropolymer may be polyvinylidene fluoride homopolymer (PVDF) or polyvinyl fluoride homopolymer (PVF) or copolymers of vinyl fluoride or vinylidene fluoride with fluorinated comonomers including fluoroolefins, fluorinated vinyl ethers, or fluorinated dioxoles. Examples of useful fluorinated comonomers include tetrafluoroethylene (TFE), hexafluoropropylene (HFP), chlorotrifluoroethylene (CTFE), trifluoroethylene, hexafluoroisobutylene, perfluorobutyl ethylene, perfluoro (propyl vinyl ether) (PPVE), perfluoro (ethyl vinyl ether) (PEVE), perfluoro (methyl vinyl ether) (PMVE), perfluoro-2,2-dimethyl-1,3-dioxole (PDD) and perfluoro-2-methylene-4-methyl-1,3-dioxolane (PMD) among many others. By copolymers, it is meant interpolymers of VF or VF2 with any number of additional fluorinated monomer units including dipolymers, terpolymers and tetrapolymers. VF copolymers are a preferred embodiment of this invention, preparation of which is taught by U.S. Pat. Nos. 6,242,547 and 6,403,740 to Uschold.

The present invention is more preferably employed with self-supporting conductive films of fluoropolymer. The fluoropolymer film can be made from liquid compositions that are either (1) solutions or (2) dispersions of fluoropolymer. Films are formed from such solutions or dispersions of fluoropolymer by casting or extrusion processes. Preferably the fluoropolymers employed are fabricable at temperatures below 225° C. Both oriented and unoriented fluoropolymer films can be used in the practice of the present invention.

Typical solutions or dispersions for polyvinylidene fluoride or copolymers of vinylidene fluoride are prepared using solvents that have boiling points high enough to avoid bubble formation during the film forming/drying process. The polymer concentration in these solutions or dispersions is adjusted to achieve a workable viscosity of the solution and in general is less than about 25% by weight of the solution. A suitable fluoropolymer film is formed from a blend of polyvinylidene fluoride, or copolymers and terpolymers thereof, and acrylic resin as the principal components as described in U.S. Pat. Nos. 3,524,906; 4,931,324; and 5,707,697. Conductive films in accordance with the invention are made by casting polymer solutions or dispersions, especially fluoropolymer solutions or dispersions having distributed therein an electrically conductive polymer composition containing linearly conjugated π-electron systems and residues of sulfonated lignin or a sulfonated polyflavonoid.

In polymer film casting processes, the polymer, preferably fluoropolymer, is formed into its desired configuration by casting the dispersion onto a support, by using any suitable conventional means, such as spray, roll, knife, curtain, gravure coaters, or any other method that permits applying a substantially uniform film without streaks or other defects. The thickness of the cast dispersion is not critical, so long as the resulting film has sufficient thickness to be self-supporting and be satisfactorily removed from a support onto which the dispersion is cast. In general, a thickness of at least about 0.25 mil (6.4 μm) is satisfactory, and thicknesses of up to about 15 mils (381 μm) can be made by using the dispersion casting techniques of the present invention. A wide variety of supports can be used for casting films according to the present invention, depending on the particular polymer and the coalescing conditions. The surface onto which the dispersion is cast should be selected to provide easy removal of the finished film after it is coalesced. While any suitable support can be employed for casting the fluoropolymer dispersion, examples of suitable supports include polymeric films or steel belts.

After casting the polymer dispersion onto the support, the polymer is dried and coalesced to form a coalesced film while in contact with the support. Depending on the polymer system, drying and coalescing can be done simultaneously or sequentially. The conditions used to dry/coalesce the polymer will vary with the polymer used, the thickness of the cast dispersion, among other operating conditions. Typically, when employing a PVF dispersion, heat is applied to dry and coalesce the polymer simultaneously. Oven temperatures of about 340° F. (171° C.) to about 480° F. (249° C.) can be used to coalesce the film, and temperatures of about 380° F. (193° C.) to about 450° F. (232° C.) have been found to be particularly satisfactory. The oven temperatures, of course, are not representative of the temperatures of the polymer being treated, which will be lower. Preferably all processing temperatures used in fabricating the film are below 225° C. so as not to degrade the conductive properties of the electronically conductive polymer. After coalescence, the finished film is stripped from the support by using any suitable conventional technique.

In an especially preferred form of the invention, using films of polyvinyl fluoride (PVF), suitable films can be prepared from dispersions of the fluoropolymer. The nature and preparation of such dispersions are described in detail in U.S. Pat. Nos. 2,419,008; 2,510,783; and 2,599,300. Suitable PVF dispersions can be formed in, for example, propylene carbonate, N-methyl pyrrolidone, γ-butyrolactone, sulfolane, and dimethyl acetamide. The concentration of PVF in the dispersion will vary with the particular polymer and the process equipment and the conditions used. In general, the fluoropolymer will comprise from about 30 to about 45% by weight of the dispersion.

Films of polyvinyl fluoride may be formed by solvent aided extrusion procedures such as those described in U.S. Pat. Nos. 3,139,470 and 2,953,818. Similar to the teaching in these patents, a liquid dispersion of polymer, preferably a fluoropolymer, and more preferably polyvinyl fluoride, having distributed therein an electrically conductive polymer composition containing linearly conjugated π-electron systems and residues of sulfonated lignin or a sulfonated polyflavonoid can be fed to a heated extruder that is connected to a slotted casting hopper. A tough coalesced extrudate of polymer is extruded continuously in the form of a film containing latent solvent. The film can be merely dried or, alternately, can be heated and stretched in one or more directions while the solvent is volatilized from the film. When stretching is used, oriented film is produced. Preferably all processing temperatures used in fabricating the film are below 225° C. so as not to degrade the conductive properties of the electronically conductive polymer.

In another embodiment, polymer, preferably fluoropolymer, is melted and electrically conductive polymer composition used for this invention is added to the melt. The melt is then extruded and allowed to cool to form a self-supporting conductive polymer film of the invention. In a preferred embodiment, the polymer has a melt temperature of less than 225° C., so as not to degrade the conductive properties of the electrically conductive polymer.

In a preferred embodiment, fluoropolymer film containing the electrically conductive polymer composition used in this invention is surface treated to enhance adherability. The surface treatment can be achieved by exposing the film to a gaseous Lewis acid, to sulfuric acid or to hot sodium hydroxide. Preferably, the surface can be treated by exposing one or both surfaces to an open flame while cooling the opposite surface. A convenient method of flame treatment employs a propane torch flame which is passed across the film with the flame several inches from the film surface. Films in accordance with the invention can be adhered onto many different supports using techniques and adhesives known in the art. Some examples include metal supports, particularly iron, steel, aluminum, stainless steel; glass, porcelain or ceramics; textile fabrics, paper, cardboard, wood, plywood, cement board or plastics. Polymeric supports may be either thermoplastic or thermosetting materials. Films of this invention can be heat sealed to many supports as well as heat sealed to itself. This ability to be heat sealed provides for the use of these films for packaging material.

Electrically Conductive Polymers

The electrically conductive polymer used in the present invention comprises linearly conjugated π-electron systems and residues of a sulfonated lignin or sulfonated flavonoid as fully taught in U.S. Pat. Nos. 5,968,417 and 6,059,999 to Viswanathan. As explained by these patent references, in linearly conjugated π-electron systems, electrons move rapidly along a partially oxidized or reduced molecular chain. The conjugated region of an individually linearly conjugated π-system preferably extends so that when the conjugated region of one linearly conjugated π-system is adjacent to the conjugated region of another linearly conjugated π-system, and an electric field is applied, an electron can flow from the first linearly conjugated π-system to the adjacent linearly conjugated π-system.

Examples of linearly conjugated π-electron systems include polymers comprising substituted and unsubstituted aromatic and heteroaromatic rings. Preferably the rings will be linked in a continuous conjugated π-network. Specific linearly conjugated π-electron systems comprise one or more conjugated regions composed of monomeric units incorporating a conjugated basic atom that can form the positive part of an ionic couple. The preferred basic atom is nitrogen. Other basic atoms include sulfur. Preferred linear conjugated π-electron systems of this invention comprise repeating monomer units of aniline, thiophene, pyrrole, or phenyl mercaptan, wherein said repeating monomer units of aniline, thiophene, pyrrole, or phenyl mercaptan are optionally ring-substituted with one or more straight or branched alkyl, alkoxy, or alkoxyalkyl groups each containing from 1–10 carbon atoms, or preferably 1–4 carbon atoms. A linear conjugated π-system of this invention may comprise 3 to 100 monomer units. The system is preferably prepared by oxidation-type polymerization. Especially preferred are the linear conjugated π-electron systems of polyaniline.

In addition to the linearly conjugated π-electron systems, the electrically conductive polymer employed in this invention has residues of sulfonated lignin or a sulfonated polyflavonoid. Sulfonated lignins (i.e., lignosulfonates) are produced as a spent liquor in the sulfite process of the paper and wood-pulp industries. Sulfonated polyflavonoids (e.g., sulfonated condenced tanins) and sulfonated lignins contain the common structural feature of sulfonated polyaryl rings that make them especially suited to preparing compositions of this invention. The residues of both sulfonated compounds can be attached to the linearly conjugated π-electron systems by ionic or covalent bonds, as well as by electrostatic interactions (e.g., hydrogen bonds). By the term "residue of", it is meant that the sulfonated polyaryl compounds comprise a radical and/or an ion of the sulfonated polyaryl compound that is attached (ionically, covalently, or electrostatically), at one or multiple sites, to one or more linearly conjugated π-electron systems. Compositions of matter can be prepared which comprise conjugated π-electron systems that are grafted (i.e., covalently bonded) to sulfonated lignin or a sulfonated polyflavonoid.

The preparation of the electrically conductive polymers used in this invention is extensively taught by U.S. Pat. Nos. 5,968,417 and 6,059,999 to Viswanathan.

Of particular interest and especially preferred for the electrically conductive polymer of this invention is lignosulfonic acid doped polyaniline, the preparation of which is taught in Example 3 of U.S. Pat. No. 5,968,417. Lignosulfonic acid doped polyaniline is also available from GeoTech Chemical Company (Akon, Ohio) under the brand name of Ligno-PANI™.

The self-supporting conductive film of the present invention contains from about 10 to about 40 weight % of the electrically conductive polymer composition of the linearly conjugated π-electron systems and residues of sulfonated lignin or a sulfonated polyflavonoid, preferably about 10 to about 35 weight %, and more preferably 15 to about 25 weight % (on a dry basis).

The electrically conductive polymer used in this invention is preferably dispersed throughout the bulk of the polymer in the film resulting in a self-supporting film with a constant resistivity on both sides of the film.

The self-supporting conductive film of the present invention has a surface resistivity of less than about $10^{10}$ ohms per square, preferably in the range of from about $10^2$ ohms per square to about $10^{10}$ ohms per square. Surface resistivity is determined by the method described below.

Unexpectedly, the electrically conductive polymers used in this invention can be uniformly dispersed in fluoropolymer compositions, especially polyvinyl fluoride, without large increases in viscosity. The introduction of electrically conductive polymers of this invention into fluoropolymer compositions permits easier processing and the ability to regulate the quantities of conductive material being added to achieve batch to batch uniformity in conductivity.

Viscosity can be controlled with the addition of electrically conductive polymers used for this invention to the fluoropolymer more effectively than with prior art conductive materials such as carbon black. Conductive fluoropolymer films of uniform thickness without streaking or skipping are produced. As will be shown by example, films with the desired constant surface resistivity on both sides of the film are produced because of the uniform distribution of the electrically conductive polymer in the fluoropolymer film. Further, the film conductivity does not change with a change in the relative humidity.

Further, as will be shown in an example that follows, increased conductivity of the film appears to be dependent upon the liquid dispersant and upon grinding time. A longer grinding time for the electrically conducting polymer, as exemplified by lignosulfonic acid doped polyaniline, results in higher film conductivity. In contrast, carbon black, an additive typically used in fluoropolymer film, loses conductivity if grinding times are too long and conversely is not conductive enough if grinding times are too short.

In yet another embodiment, the electrically conductive polymer composition further contains metal particles. The composition with metal particles when added to polymers of the films allows the formation of electrically conductive films that can inhibit corrosion on architectural metal structures, such as steel and iron. The films provide both barrier and active protection. Metal particles, that are less noble than steel or iron, function as a more active anode than the steel or iron substrate. The metal particles provide electrons and the ICP provides the conductivity for the electrons to flow. This effectively short circuits the electrochemical rust mechanism and sacrifices the protecting film rather than causing damage to the metal. In a preferred embodiment the metal particles are aluminum. Such films could provide a primer layer for these architectural structures which primers may then have an additional weatherable and/or decorative over layer.

Uses

There are a number of uses for self-supporting conductive films in accordance with the invention. Conductive films laminated to plastic supports can be used as workbenches in the electronics industry. Conductive films of this invention when heat sealed can be used as packages, preferably in the form of bags, to transport electronic components without the risk of building an electrical charge. The self-supporting, conductive fluoropolymer films provide great benefit to those applications requiring both chemical resistance and electrodissipation such as in clean rooms for the manufacture of precision instruments. Self-supporting films in accordance with the invention are particularly useful as wall coverings in clean room environments. Films in accordance with the invention can be used as electromagnetic interference shielding for radios, radar and TV cabinets, computers and the like. As mentioned above, the films can provide both barrier and active protection for architectural metal structures when the films additionally contain sacrificial metal particles.

TEST METHODS

Surface Resistivity—Cast film is stripped from the support and tested for conductivity using Model SRM 110 meter (available from Bridge Technologies, Chandler Heights Ariz.).

Tensile Strength and Elongation-to-Break—Cast film is stripped from the support and subjected to the standard test procedure described in ASTM D638.

Bond Strength—Bond strength of laminated film structures is determined by subjecting the laminate to testing on a Chatillon TCD 200 tester (available from Ametek, Paoli Pa.). Bond strength is determined by making a laminate of conductive film to aluminum substrate having a thickness of 0.025 in (6.4 mm) (available as AL612 from Q panel Cleveland Ohio). An adhesive of dry 68040 (available from DuPont, Wilmington Del.) approximately 0.002 in (0.05 mm) thick is used to adhere the conductive film to the substrate. The laminate is placed in a heat sealer for 10 seconds at 154° C. with approximately 3 in (7.6 cm) of film not adhered to the substrate and 1 in (2.5 cm) adhered. The non-adhered film is placed in the jaws of the Chatillon puller and the aluminum substrate is placed in stationary jaws. The film is pulled at 180 degrees versus the substrate and the maximum force before film break or delamination is recorded. The type of delamination (film break or film delamination from the adhesive) is noted.

EXAMPLES

Films and coating materials according to this invention are made and tested. Unless otherwise noted, all parts and percentages are on a weight basis.

Example 1

This example illustrates the formation of cast conductive polyvinyl fluoride (PVF) film.

A dispersion of electrically conductive polymer is prepared by grinding 18 parts of lignosulfonic acid doped polyaniline sold as Ligno-PANI™ (distributed by Seegott, Streetsboro, Ohio) with 70 parts propylene carbonate and 12 parts PVF particulate resin (available from DuPont Fluoroproducts, Wilmington Del. as PV-116) with 1 mm glass media (available from Glen Mills Inc, Clifton N.J.) in a paint shaker (available from Red Devil Equipment Co, Brooklyn Park, Minn.) for 15 minutes.

A homogeneous dispersion of polyvinyl vinyl fluoride in propylene carbonate is prepared by grinding 40 parts of PVF with 60 parts propylene carbonate in 1 mm glass media using a Model LMJ 2 mill (available from Netzsch Inc of Exton, Pa.).

100 parts of the electronically conductive polymer dispersion is added to 158 parts of the media milled PVF/propylene carbonate dispersion to form a mixture of dispersions. The dispersion mixture is cast onto a matte polyester film support, available as Melinex 337 from DuPont Teijin Films, by casting the film using a 5 mil (125 μm) doctoring blade. The cast film is dried by baking at 180° C. in an oven for 5 minutes. For the first two minutes of baking time, the dispersion is covered. For the last 3 minutes the wet film is uncovered. The film is stripped from the support and tested for conductivity using Model SRM 110 meter (available from Bridge Technologies, Chandler Heights Ariz.). The film is approximately 1 mil (25.4 μm) thick and is continuous having no holes. The tensile strength at break is 6000 pounds per square inch (41 MPa) in either direction and % elongation-at-break is 8. The surface resistivity is $10^4$ ohms per square.

Example 2

This example illustrates the formation of cast conductive polyvinylidene fluoride (PVDF) film.

A dispersion of PVDF and lignosulfonic acid doped polyaniline is prepared by grinding 33 parts of PVDF (available as Kynar 301 from Atofina, Philadephia, Pa.), 67 parts of propylene carbonate, and 7 parts of the polyaniline in a paint shaker. The glass media is separated from the dispersion and the dispersion cast onto a polyester web and baked for 5 minutes under the same conditions stated in Example 1. The dried film is stripped from the web support and measured for surface conductivity. The film is approximately 1 mil (25.4 μm) thick. The surface resistivity is $10^4$ ohms per square.

Example 3

This example illustrates the formation of cast vinyl fluoride dipolymer film.

A vinyl fluoride dipolymer of vinyl fluoride and tetrafluoroethylene (VF/TFE ~40/60 mole %) is prepared according to the teaching described in U.S. Pat. No. 6,403,740 B1 (Uschold) using the procedure below.

A stirred jacketed stainless steel horizontal autoclave of 7.6 L (2 U.S. gal) capacity is used as the polymerization vessel. The autoclave is equipped with instrumentation to measure temperature and pressure and with a compressor that can feed monomer mixtures to the autoclave at the desired pressure. The autoclave is filled to 55–60% of its volume with deionized water containing 50 mL of Fluorad® FC118 20% aqueous ammonium perfluorooctanoate (3M Corp., St. Paul, Minn.) as a surfactant. It is then pressured to 2.1 MPa (300 psi) with nitrogen and vented three times. The water is then heated to 90° C. and monomers in the desired ratio were used to bring the autoclave pressure to 2.1 MPa. Initiator solution is prepared by dissolving 2 g APS in 1 L of deionized water. The initiator solution is fed to the reactor at a rate of 25 mL/min for a period of five minutes and then the feed rate is reduced and maintained at 1 mL/min for the duration of the experiment. The autoclave is operated in a semibatch fashion in which the desired monomer mix is added to the reactor as polymerization occurred to maintain constant pressure. To do this, the monomer feed is recycled through a loop from the high pressure side of the compressor to the low pressure side. Some of this recycle monomer stream is admitted to the autoclave by means of an automatic pressure regulated valve. Fresh monomer feed is added in the desired ratio to the balance of the recycle stream on low pressure side of the recycle loop to make up for the material sent to the reactor. Monomer feeds are continued until a predetermined amount to give the final latex solids is fed to the autoclave. About 2 hours is required to complete the polymerization. The feed is then stopped and the contents of the autoclave are cooled and vented. The polymer latex is easily discharged to a receiver as a milky homogeneous mixture. Polymer is isolated on a suction filter by adjusting the latex pH to about 5.0 with 10% NaOH and adding 4.0 g $MgSO_4.7H_2O$ dissolved in water per liter of latex. The filter cake is washed with water and dried in an air oven at 90–100° C. The reactor pressure is 2.1 MPa, reactor temperature is 90° C., total monomer feed is 1381.0 g, the amount of TFE in the polymer 43.3 mol % and the solids is 23.3 wt %.

Using the same preparation method as described in Example 2, dispersion of 100 parts of the vinylfluoride/tetrafluoroethylene (60/40) copolymer as prepared above, 300 parts propylene carbonate, and 25 parts lignosulfonic acid doped polyaniline is prepared, cast on a polyester support, baked and stripped to form a cast film. The film is approximately 1 mil (25.4 μm) thick. The surface resistivity is $10^4$ ohms per square.

Example 4

This example illustrates the formation of cast vinyl fluoride terpolymer film.

A vinyl fluoride terpolymer of vinyl fluoride(VF), tetrafluoroethylene (TFE), perfluorobutyl ethylene (PFBE) [TFE/VF/PFBE ~60/40/8 mole %] is prepared in a stirred jacketed stainless steel horizontal autoclave of 11.4 L (3 U.S. gal)capacity. The autoclave is equipped with instrumentation to measure temperature and pressure and with a compressor that could feed monomer mixtures to the autoclave at the desired pressure. The autoclave is filled to 55% of its volume with 6.2 L deionized water containing 45 mL of Fluorad® FC-118 surfactant [3M Co., St. Paul, Minn.] and heated to 90° C. It is then pressured to 2.1 MPa (300 psig) with nitrogen and vented three times. The autoclave is precharged with monomers in the weight ratio 60.5/33.0/6.5 for TFE/VF/PFBE, respectively, and brought to the working pressure of 2.1 MPa (300 psig). Initiator solution is prepared by dissolving 2 g APS in 1 L of deionized water. The initiator solution is prepared by dissolving 15 g/L APS in deionized water which is then fed to the reactor at a rate of 25 mL/min for a period of five minutes. The rate is then reduced and maintained at 1 mL/min for the duration of the experiment. The autoclave is operated in a semibatch fashion in which a monomer mixture added to the reactor to maintain constant pressure as polymerization occurred. The composition of this make-up feed is in the weight ratio of 57.4/35.2/7.4 for TFE/VF/PFBE, respectively, and is different from the precharged mixture because of the differences in monomer reactivity. The composition is selected to maintain a constant monomer composition in the reactor so compositionally homogeneous product is formed. Make-up monomer feed consisting of TFE and VF is recycled through a loop from the from the high pressure side of the compressor to the low pressure side. A side stream is of monomer from this loop is admitted to the autoclave by means of an automatic pressure regulated valve to maintain reactor pressure. PFBE is fed as a liquid by an automatically controlled pump when the gaseous monomers were fed to the reactor. Fresh TFE and VF were simultaneously added in the desired ratio to the recycle stream on low pressure side of the loop to make up for the material sent to the reactor. Monomer feeds were continued until a predetermined amount to give the final latex solids is fed to the autoclave. About 2–3 hrs. are required to complete the polymerization. The feed is then stopped and the contents of the autoclave were cooled and excess monomers were vented. The polymer latex is easily discharged to a receiver as a milky homogeneous mixture containing 21.6 wt % solids. Polymer dispersion coagulated by adding 15 g of ammonium carbonate dissolved in water per liter of latex followed by 70 mL of HFC-4310 (1,1,1,2,3,4,4,5,5,5-decafluoropentane) per liter of latex with rapid stirring. A granular slurry of product is formed which is collected on a filter. The filter cake is washed with water and dried in an air oven at 90–100° C. Analysis of the product by F-nmr showed it to be 42.5% mole TFE, 55.4 mole % VF and 2.1 mole % PFBE. The melting point by DSC is 177° C. and the viscosity of a 40% polymer/60% DMAC mixture by weight at 150° C. and 100/sec shear rate is 173 Pa·sec by capillary rheometry.

Using the same preparation method as described in Example 2, dispersion of 100 parts of TFE/VF/PFBE (60/40/8) terpolymer prepared above, 300 parts propylene carbonate, and 25 parts lignosulfonic acid doped polyaniline is prepared, cast on a polyester support, baked and stripped to form a cast film. The film is approximately 1 mil (25.4 μm) thick. The surface resistivity is $10^4$ ohms per square.

Example 5

This example illustrates the preparation of a laminate structure incorporating electrically conductive PVF film thereby showing that flame treated conductive PVF film can be adhered to other substrates and also can be heat sealed to itself.

Using the method described in Example 1 a conductive film of PVF containing lignosulfonic acid doped polyaniline is prepared by mixing 100 grams of the Ligno Pani dispersion in Example 1 and 52.6 grams of PVF propylene carbonate dispersion and subsequently cast, dried and stripped from the support. The cast film is flame treated using a propane torch flame (Bernzomatic Propane torch available from Bernzomatic, Medina N.Y.) and passing it across the film with the flame approximately three inches from the film surface. Approximately, a layer 0.002 in (0.05 mm) thick of an acrylic adhesive, 68040 available from DuPont Fluoroproducts is coated onto an aluminum substrate having a thickness of 0.25 inch (6.5 mm) available as AL 612 from Q Panel, located in Cleveland, Ohio). The treated side of the cast conductive PVF film is applied onto the adhesive of the coated aluminum and sealed at 170° C. for 10 seconds at 25 psi using a heat sealer (Pack Rite Machines, Franksville, Wis.). The sample is pulled on a Chatillon TCD 200 tester (available from Ametek, Paoli Pa.). Attempts to pull the film from the substrate resulted in the film breaking. No adhesion loss of the bond is observed before the film breaks at 1150 grams per lineal inch.

Comparative Example 1

This example illustrates that the often used alternate method of corona treating to increase adhesion of PVF films is not a useful treatment for electrically conductive PVF.

In a paint shaker using 1 mm glass media for grinding, a dispersion is prepared containing, 100 parts of previously milled 40% solids PVF in propylene carbonate dispersion, 50 parts N-methyl pyrrolidone (available from Aldrich Chemical Milwaukee Wis.) and 20 parts lignosulfonic acid doped polyaniline by shaking for 10 minutes. As in example 1 the propylene carbonate dispersion is cast, dried and stripped from the support. The resultant film had 6% elongation.

The film is corona treated with a Tesla coil and adhered to adhesive-coated aluminum substrate in the same manner as Example 5. After heat sealing the laminate is subjected to the bond strength test as described above. At 120 g/in, the film is peeled from the substrate.

Example 6

This example illustrates the effect of altering the dispersion medium and varying grinding time.

In a paint shaker using 1 mm glass media for grinding, three separate dispersions are prepared, each containing, 100 parts of previously milled 40% solids PVF in propylene carbonate dispersion, 50 parts N-methyl pyrrolidone (available from Aldrich Chemical Milwaukee Wis.) and 20 parts lignosulfonic acid doped polyaniline. The first dispersion is ground for 10 minutes in the paint shaker. The second dispersion is ground for 20 minutes. The third dispersion is ground for 30 minutes. To all three dispersions, an additional 16.8 parts of PVF/propylene carbonate dispersion is added to reduce the weight percent of the polyaniline in the film to 28 for the purpose of improving coating viscosity.

Using the method described in Example 1, the dispersions are cast on a polyester support, baked and stripped to form cast films. The films are approximately 1 mil (25.4 μm) thick. The films are tested for conductivity using SRM 110 meter. The 10-minute ground dispersion produces a cast film with a surface resistivity of $10^9$ ohms per square. The 20-minute ground dispersion produces a film with a surface resistivity of $10^6$ ohms per square. The 30-minute ground dispersion produces a film with a surface resistivity of $10^5$ ohms per square. This example shows that conductivity improves with grinding time in the systems tested and that maximum conductivity has not been reached even after 30 minutes of grinding of the systems tested.

Example 7

This example illustrates the preparation of electroconductive films of fluoropolymer blended with non-fluoropolymers.

In a paint shaker using 1 mm glass media for grinding, a dispersion is prepared containing, 35 parts PVDF, 187 parts N-methyl pyrrolidone by shaking for 10 minutes. After grinding and filtering 173 parts of the PVDF/NMP dispersion is combined with 50 parts of acrylic polymer 68080 available from DuPont Fluoroproducts and mixed thoroughly using a paint shaker for 5 minutes. To this mixture is added 71.5 parts of the Ligno Pani™/PVF/propylene carbonate dispersion used in Example 1 is added. A film is cast on a polyester support and baked at 170° C. for 5 minutes. The dried film is stripped from the support and tested. The film is approximately (25.4 μm) thick. The surface resistivity is $10^6$ ohms per square.

Example 8

This example illustrates constant surface resistivity on both sides of the film.

A 25% weight solids dispersion of Ligno Pani™ in NMP is created by grinding the two constituents with 1 mm media in a paint shaker for 15 minutes. After filtering the media from the dispersion, 160 parts of the dispersion is added to 100 parts of a 40% solids PVF/propylene carbonate dispersion. The dispersions were mixed thoroughly then cast onto a Melinex 442 web. After drying, the film is approximately 1.7 mils thick. On the air side, the film resistivity is $10^6$ and the web side is also $10^6$ ohms per square.

Example 9

In this example, an electrically conductive polymer composition is prepared in a mixture of liquid dispersants.

A dispersion of electrically conductive polymer is prepared by grinding 10 parts of lignosulfonic acid doped polyaniline sold as Ligno-PANI™ (distributed by Seegott, Streetsboro, Ohio) with 80 parts of N-methyl pyrrolidone (available from Aldrich Chemical Milwaukee Wis.) and 20 parts PVF particulate resin (available from DuPont Fluoroproducts, Wilmington Del. as PV-116) with 1 mm glass media (available from Glen Mills Inc, Clifton N.J.) in a paint shaker (available from Red Devil Equipment Co, Brooklyn Park, Minn.) for 15 minutes.

Added to the above mixture, is a 40% weight solids polyvinyl fluoride in propylene carbonate (available from Huntsman Chemical, Houston Tex.) dispersion created using a media mill in various ratios of the two dispersions as shown in Table 1 to form a mixture. Each dispersion mixture is drawn onto glass and baked at 180° C. for 10 minutes. For the first five minutes of baking time, the dispersion is covered. For the last five minutes the wet film is uncovered. The film is stripped from the support and tested for conductivity using SRM 110 meter (available from Bridge Technologies, Chandler Heights Ariz.). Resistivity results are also shown in Table 1.

TABLE 1

| | 1 | 2 | 3 | 4 | 5 | 6 | 7 |
|---|---|---|---|---|---|---|---|
| Polyaniline Dispersion | 100 | 75 | 50 | 62.5 | 56.5 | 53.4 | 51.57 |
| PVF/PC Dispersion | 0 | 25 | 50 | 37.5 | 43.5 | 46.6 | 48.43 |
| Dry Film Resistivity (ohms/square) | $10^5$ | $10^5$ | $10^{12}$ | $10^6$ | $10^7$ | $10^8$ | $10^9$ |

Example 10

Using the dispersions of Example 9, two electrically conductive coating compositions are produced. The viscosity of each mixture is measured using a Brookfield viscometer. The compositions and viscosity of the compositions are shown in Table 2.

TABLE 2

| | 1 | 2 |
|---|---|---|
| Polyaniline Dispersion | 75 | 55 |
| PVF/PC Dispersion | 25 | 45 |
| Brookfield Viscosity (30 rpm) | 5600 | 11800 |

Unexpectedly, a reduction in viscosity is observed with an increased amount of ICP. Reduced viscosity is beneficial to film casting operations.

Comparative Example 2

A PVF/carbon black dispersion at similar solids as coating composition in Table 2 is created by mixing a media milled dispersion of 15 parts Raven Black 16 (Columbian Chemicals, Marietta Ga.) 8.7 parts PVF, 6.2 parts Disperbyk 160 (Byk Chemie, Wllingford Conn.), and 70.1 parts n-methyl pyrrolidone with a 40% solids PVF/propylene carbonate mixture. The mixture ratio is 35.79% black dispersion and 64.21% PVF/propylene carbonate dispersion. The mixture is drawn down and baked under the same conditions as Example 8. The film has a resistivity of $10^8$ ohms per square. The casting viscosity is 15800 centipoises.

It is observed that the electrically conductive polymer dispersion of the invention, exemplified by coating composition 2 of Example 9, has a similar resistivity to dispersions containing carbon black at the same loading and solids level as well as a much reduced viscosity. Further it is observed, that larger amounts of ICP's, as exemplified by coating composition 1 of Example 9, can be incorporated into electrically conductive polymer dispersions producing a substantially less viscous dispersion than that produced using carbon black. Reduced viscosity has great advantages in casting operations.

What is claimed is:

1. A process for producing self-supporting conductive polymer film comprising:

preparing a coalescible liquid dispersion of polymer and an electrically conductive polymer composition containing linearly conjugated π-electron systems and residues of sulfonated lignin or a sulfonated polyflavonoid, casting said liquid dispersion onto a support to form a conductive polymer film, drying and coalescing said conductive polymer film while in contact with the support, and subsequently removing said coalesced conductive polymer film from said support.

2. The process of claim 1, further comprising flame treating said coalesced conductive polymer film.

3. The process of claim 1 wherein said coalescible liquid dispersion of polymer is a dispersion of fluoropolymer.

4. The process of claim 1 wherein said self-supporting conductive polymer film is fabricated at a temperature of less than about 225° C.

5. The process of claim 1 wherein said liquid dispersion further comprises metal particles.

6. The process of claim 5 wherein said metal particles are alumnium.

7. A process for producing self-supporting conductive polymer film comprising:

preparing a coalescible liquid dispersion of fluoropolymer and an electrically conductive composition containing linearly conjugated π-electron systems and residues of sulfonated lignin or a sulfonated polyflavonoid, extruding said liquid dispersion into an extrudate, and applying heat to said extrudate to volatize said liquid and form a coalesced self-supporting conductive polymer film.

8. The process of claim 7 wherein said self-supporting conductive polymer film is fabricated at a temperature of less than about 225° C.

9. The process of claim 7 wherein said coalesced self-supporting conductive polymer film is stretched to produce oriented film.

10. The process of claim 7 wherein said liquid dispersion further comprises metal particles.

11. The process of claim 10 wherein said metal particles are aluminum.

* * * * *